United States Patent [19]

McClellan

[11] Patent Number: 4,567,699

[45] Date of Patent: Feb. 4, 1986

[54] PREFABRICATED PANEL AND BUILDING SYSTEM

[76] Inventor: Thomas A. McClellan, 8888 Riverside Dr. East, Apt. 609, Windsor, Ontario, Canada, N8S 1H2

[21] Appl. No.: 669,750

[22] Filed: Nov. 8, 1984

Related U.S. Application Data

[63] Continuation of Ser. No. 340,979, Jan. 20, 1982, abandoned.

[51] Int. Cl.[4] ..... E04B 1/60; E04C 1/39; E04C 1/40

[52] U.S. Cl. ..... 52/127.7; 52/221; 52/241; 52/300; 52/586; 52/600; 52/782

[58] Field of Search ..... 52/241, 243, 238.1, 52/586, 600, 782, 221, 300, 127.7

[56] References Cited

U.S. PATENT DOCUMENTS

| | | | |
|---|---|---|---|
| 1,693,742 | 12/1928 | Bemis | 52/238.1 X |
| 1,985,196 | 12/1934 | Tashjian | 52/241 |
| 2,046,152 | 6/1936 | Dean | 52/301 |
| 2,049,190 | 7/1936 | Bemis | 52/586 X |
| 2,132,832 | 10/1938 | Prive | 52/241 X |
| 2,154,661 | 6/1969 | Bloom | 52/600 X |
| 2,202,850 | 6/1940 | Guignon, Jr. | 52/300 X |
| 2,325,254 | 7/1943 | Lefebure | 52/241 |
| 2,548,576 | 4/1951 | Willson | 52/586 X |
| 2,862,254 | 12/1958 | Meek | 52/586 X |
| 3,133,322 | 5/1964 | Douglas | 52/288 |
| 3,206,903 | 9/1965 | Johnson | 52/303 |
| 3,254,464 | 6/1966 | Hoyt, Jr. | 52/586 |
| 3,538,660 | 11/1970 | Moor | 52/586 X |
| 3,623,288 | 11/1971 | Horowitz | 52/586 |
| 4,087,944 | 5/1978 | Mecklenburg | 52/241 |

FOREIGN PATENT DOCUMENTS

| | | | |
|---|---|---|---|
| 293902 | 9/1969 | Australia | 52/241 |
| 816753 | 10/1951 | Fed. Rep. of Germany | 52/586 |
| 1484310 | 1/1969 | Fed. Rep. of Germany | 52/284 |
| 115053 | 5/1926 | Switzerland | 52/300 |

*Primary Examiner*—Alfred C. Perham
*Attorney, Agent, or Firm*—Barnes, Kisselle, Raisch, Choate, Whittemore & Hulbert

[57] ABSTRACT

A prefabricated building system comprising a plurality of prefabricated panels. Each panel comprises a formed body of insulating material having a top, bottom, sides and a front face and back face. At least one hollow tubular load bearing member is embedded in the body intermediate the sides and faces thereof and extend vertically between the top and bottom. The tubular load bearing members have a slot in the top and bottom thereof, the slots having their axes generally parallel to the front and rear faces of the body. A bottom member is provided along the floor and has an upstanding flange extending into the slots at the bottom of the tubular member and a top member extends along the top of the panels and has a flange extending downwardly into the slots in the tops of the tubular load bearing members. The load bearing members have a length greater than the length of the body so that vertical loads are not transmitted to the body.

17 Claims, 12 Drawing Figures

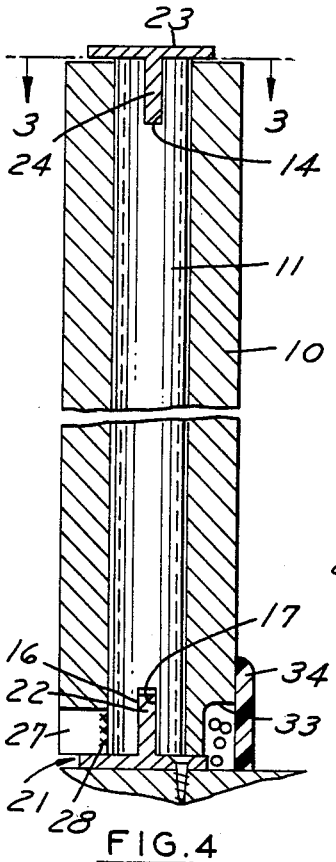
FIG.4
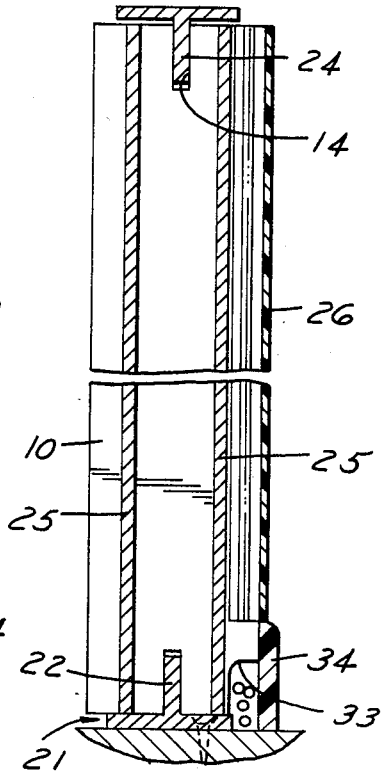
FIG.5
FIG.6
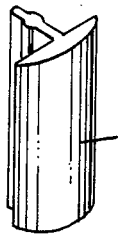
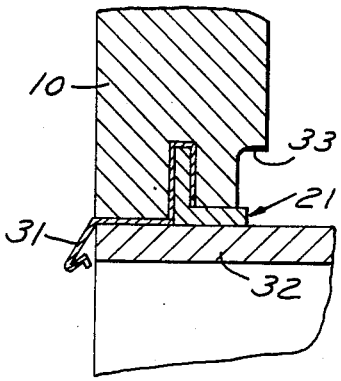
FIG.7
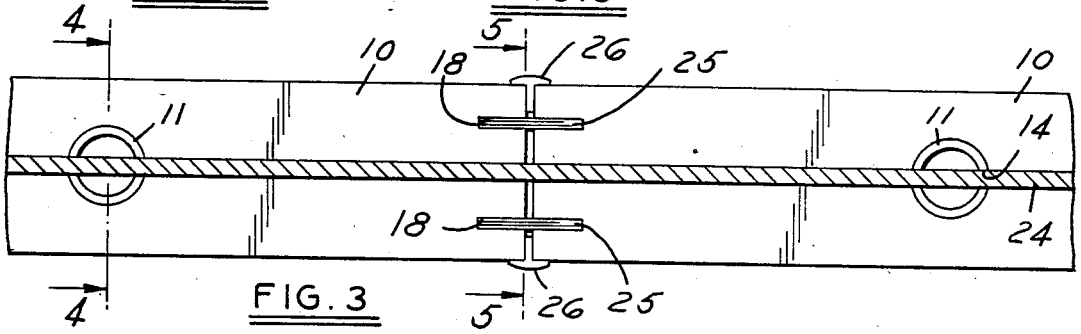
FIG.3
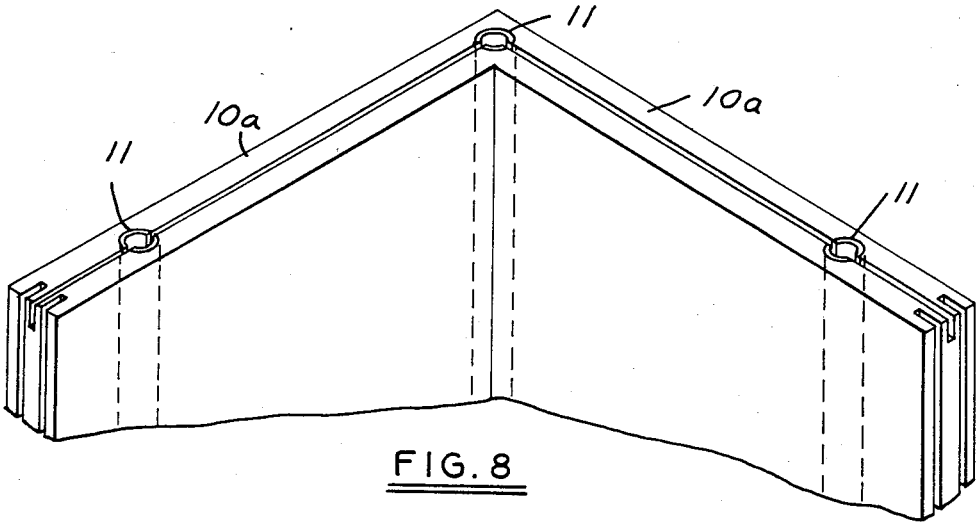
FIG.8

PREFABRICATED PANEL AND BUILDING SYSTEM

This application is a continuation of application Ser. No. 340,979, filed Jan. 20, 1982, now abandoned.

This invention relates to prefabricated panels and buildings utilizing prefabricated panels.

BACKGROUND AND SUMMARY OF THE INVENTION

The use of prefabricated panels in buildings has become very common. In many instances, the panels are not constructed so that they can absorb longitudinal or transverse loads and therefore a separate frame is also utilized in conjunction with the panels. Where the panels are intended to be load bearing, substantial reinforcement must be provided by an individual framing for the panel or the like.

Among the objectives of the present invention are to provide a low cost panel which will support loads without the need for framing or complex reinforcing; which panels may be assembled in a novel manner to provide a building system; and to a method of assembly of such building system.

In accordance with the invention, the prefabricated building system comprises a plurality of prefabricated panels. Each panel comprises a formed body of insulating material having a top, bottom, sides and a front face and back face. At least one hollow tubular load bearing member is embedded in the body intermediate the sides and faces thereof and extend vertically between the top and bottom. The tubular load bearing members have a slot in the top and bottom thereof, the slots having their axes generally parallel to the front and rear faces of the body. A bottom member is provided along the floor and has an upstanding flange extending into the slot of the bottom of the tubular member and a top member extends along the top of the panels and has a flange extending downwardly into the slots in the top of the tubular load bearing members. The load bearing members have a length greater than the length of the body so that vertical loads are not transmitted to the body.

DESCRIPTION OF THE DRAWINGS

FIG. 3 is a fragmentary top plan view of a portion of the system shown in FIG. 1, taken along the line 3—3 in FIG. 4.

FIG. 4 is a fragmentary sectional view taken along the line 4—4 in FIG. 3.

FIG. 5 is a fragmentary sectional view taken along the line 5—5 in FIG. 3.

FIG. 6 is a fragmentary perspective view of a sealing strip used in the system.

FIG. 7 is a fragmentary sectional view showing the system at the base of a building.

FIG. 8 is a fragmentary perspective view of a modified form of panel.

DESCRIPTION

Figure 1:
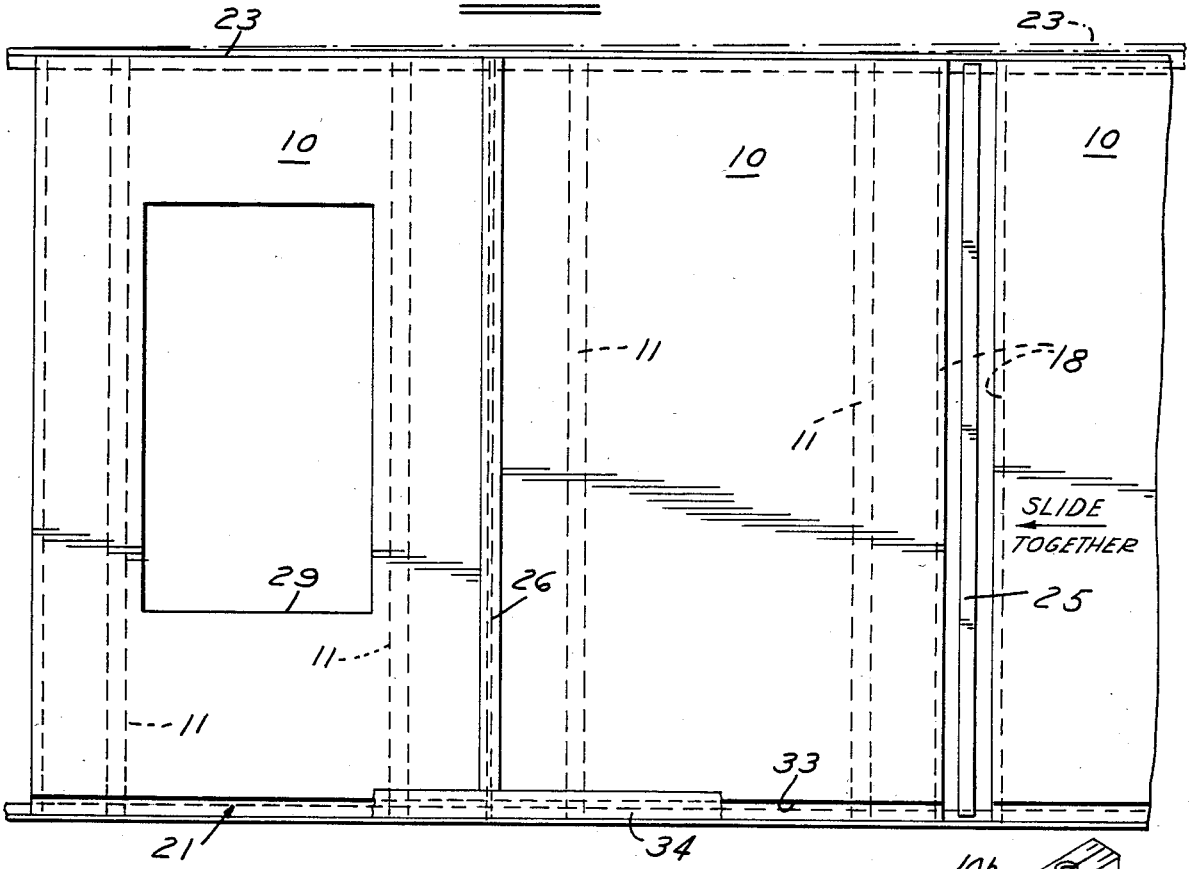
FIG. 1 is a fragmentary side elevational view of a prefabricated building system embodying the invention.

Referring to FIG. 1, the building system embodying the invention incorporates a plurality of prefabricated panels 10 that are joined, as presently described, to form a wall or walls of a building.

Figure 2:
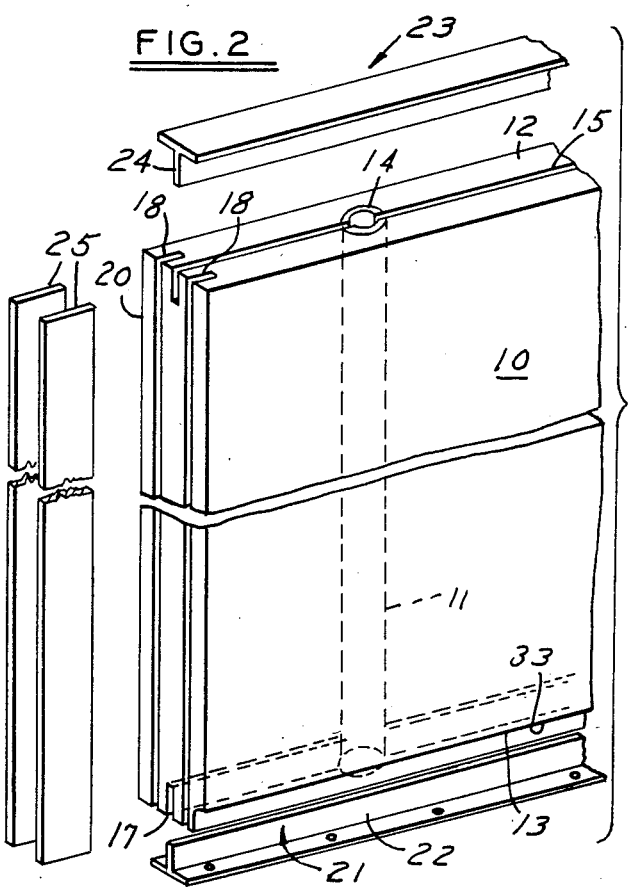
FIG. 2 is a fragmentary exploded perspective view of a portion of the building system.

As shown in FIG. 2, the prefabricated panel 10 comprises a formed body of insulating material having at least one and preferably two vertically extending hollow tubular load bearing members 11 such as a pipe extending from the top 12 to the bottom 13. Each member 11 further includes a slot 14 in the upper end thereof that extends longitudinally of the panel 10 and is aligned with a complementary slot 15 in the body 10.

The bottom of each member 11 is similarly formed with a slot 16 aligned with a complementary slot 17 in the bottom of the panel 10.

Each panel 10 further includes a pair of vertical slots 18 in each side 20. The tubular load bearing members 11 are positioned intermediate the inner and outer faces of the panel 10 so that they are entirely embedded therein except for the exposed ends at the top and bottom which project beyond the top and bottom.

The system further includes a member 21 that is fastened to the floor and extends along the floor having a length greater than a single panel which has an upstanding flange 22 that extends upwardly into the slots 17 of the panels 10 that are positioned on the members 21. In addition, a top member 23 is provided having a downwardly extending flange 24 that extends into the slot 15 of the body of the panel and the slots 14 of the load bearing members 11. The joint between adjacent panels 10 is provided by strips 25 that are inserted in the aligned slots 18. Finally, a T-shaped joint 26 is inserted in the gap between adjacent panels to provide an aesthetic appearance between adjacent panels.

The bottom members 21 and top members 23 may have various configurations such as a T-shape or L-shape to form the respective flanges.

As shown in FIG. 4, the load bearing members 11 project slightly above and below the top and bottom of each panel 10 so that the entire load on the top member 23 is transmitted to the load bearing member 11 and through the load bearing member to the bottom member 21. As shown in FIG. 5, the slots 15, 17 at the top and bottom of the panels are deep enough with respect to the flanges 22, 24 that there will be no engagement and none of the load will be transmitted through the body as contrasted to the load bearing members 11.

Figure 10:
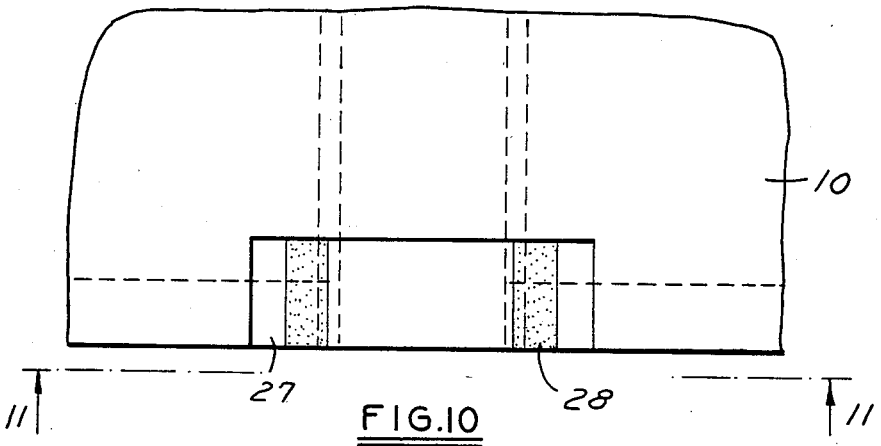
FIG. 10 is a fragmentary elevational view of a portion of the system.
Figure 11:
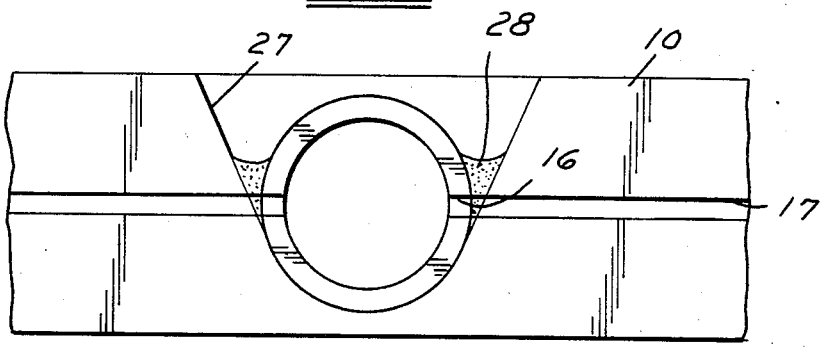
FIG. 11 is a fragmentary bottom plan view of a portion of the system shown in FIG. 10.
Figure 12:
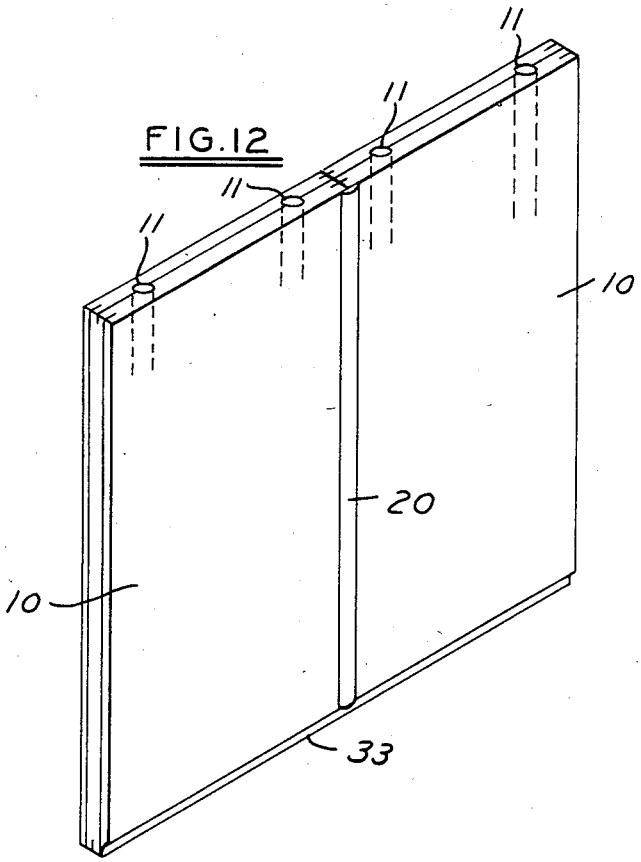
FIG. 12 is a perspective view of a system embodying the invention.

As shown in FIGS. 4, 10 and 12, each panel 10 is preferably formed with an exposed area or recess 27 so that access can be provided to the top and bottom of each load bearing member 11 for welding the load bearing member to the respective top and bottom members 23, 21 as at 28. Alternatively, the load bearing members 11 may extend beyond the top and bottom of the body of the panel so that direct access is obtained for welding without the need for recesses 27.

The space can be formed in the panel either during the molding of the panel or after the panel is formed by cutting away a portion of the panel.

In a preferred form, the mixture from which the panel is provided may comprise plastic materials or cementitous materials such as pearlite or vermiculate which form solid light weight insulating bodies. An appropriate mixture is mixed and poured into a mold that has previously positioned therein one or more load bearing members 11. If necessary, the mold is vibrated and thereafter is permitted to set so that the mixture will be cured.

If a window or door is to be provided, the window opening 29 (FIG. 1) can be provided either during molding or after molding. Similarly, the door opening 30 (FIG. 9) can be so provided. Hollow members 11 may serve as conduits for utilities such as electric wires, water pipes or gas pipes.

Decorative or protective layers or coatings can be applied to the faces of the body during or after forming.

Where the panels are to be used on a base floor on the exterior of the building, the flashing strip 31 can be interposed between the panel and the floor 32 as shown in FIG. 7. In this form, the bottom member 21*a* is L-shaped rather than T-shaped.

It is contemplated that the panels need not be planar but may be formed with two portions as shown in FIG. 8 wherein portions 10*a* are molded into a corner structure with a load bearing member 11 at the corner and load bearing members 11 in each of the angular portions.

Figure 9:
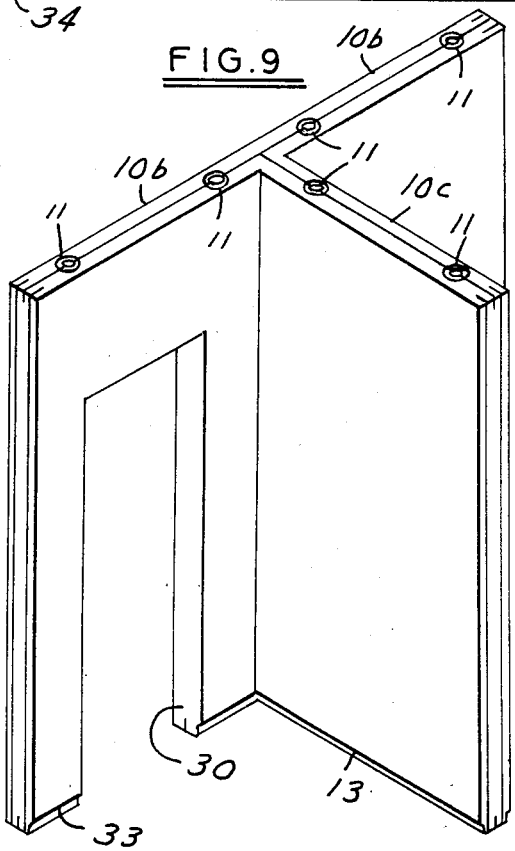
FIG. 9 is a perspective view of a further modified form of panel.

Similarly, in the form shown in FIG. 9, a T-shaped panel is provided which has portions 10*b* in the same plane and portion 10*c* at right angles thereto. In this form, each portion 10*b*, 10*c* has preferably two load bearing members.

As shown in FIG. 2, the panel 10 is further formed with a groove 33 along the lower face of one side thereof for receiving wiring and the like (FIG. 4). In the completed building construction, this groove is covered by an additional base molding or strip 34.

It can thus be seen that there has been provided a novel prefabricated panel which will absorb the load, which panel can be manufactured at low cost; which panels can be assembled readily in an economical fashion; and which will provide a pleasant appearance.

In the assembly of panels, it is contemplated that the bottom member 21 will be positioned along the floor and fastened thereto. A first panel is then positioned with the flange 22 engaging the slot 17 in the bottom thereof. Successive panels are placed in position and joining strips 25 are moved axially downwardly into slots 18 of the adjacent panels. A short bridge section leaving the cross-section of top member 23 can be used between adjacent panels to temporarily hold adjacent panels in position until the entire wall is erected. The top member 23 is then positioned on the first panel and the member 23 is successively moved downwardly in an angular fashion to progressively engage the flanges 24 of successive panels with slots 15 in the top of the panels and the slots 14 in the tubular load bearing members 11.

I claim:

1. A prefabricated panel comprising a formed body of insulating material having a top, bottom, sides and a front face and back face, at least one tubular load bearing member embedded in said body intermediate the sides and faces thereof and extending vertically from the top and bottom, said panel including a slot along the top and bottom extending parallel to the front and rear faces of the body, said tubular member having a cross slot in the top and bottom thereof, each said slot having its axis generally parallel to the front and rear faces of said body and aligned with the slot in said body, the axial depth of the slots in the load bearing members being less than the depth of the associated slot in the body such that any load applied to said slots will be transmitted only to the load bearing members.

2. The prefabricated panel set forth in claim 1 wherein a bottom member is provided having an upstanding flange, said flange engaging the base of said slot in said bottom of said tubular member.

3. The prefabricated panel set forth in claim 1 or 2 including a top member having a downwardly extending flange engaging the slot in the top of the tubular member.

4. The prefabricated panel set forth in claim 3 wherein said tubular member is welded to said top member.

5. The prefabricated panel set forth in claim 1 wherein the sides of said panel are each provided with spaced vertically extending slots adapted to receive interconnecting strips when adjacent panels are brought into side-by-side relationship.

6. The prefabricated panel set forth in claim 1 wherein said panel has a plurality of substantially parallel tubular load bearing members each of which is provided with a slot at the top and bottom thereof.

7. The prefabricated panel set forth in claim 1 wherein said body is formed with first and second portions defining a corner, a tubular member having slots therein in each portion and an additional tubular member at the intersection of the two portions at the corner.

8. The prefabricated panel set forth in claim 1 including a groove at the lower edge of one face of said panel adapted to receive utilities.

9. The prefabricated panel set forth in claim 1 wherein said panel has portions of the body thereof adjacent the upper and lower ends of said tubular member cut away providing access to the tubular member and respective top or bottom members for welding thereto.

10. A prefabricated panel comprising a molded body of insulating material having a top, bottom, sides and a front face and back face, a plurality of hollow tubular load bearing members embedded in said body intermediate the sides and faces thereof and extending vertically from the top and bottom, said panel including a slot along the top and bottom extending parallel to the front and rear faces of the body, each said hollow tubular member having a cross slot in the top and bottom thereof, each said slot having its axis generally parallel to the front and rear faces of said body and aligned with the slot in said body, the axial depth of the slots in the load bearing members being less than the depth of the associated slot in the body such that any load applied to said slots will be transmitted only to the load bearing members.

11. The prefabricated panel set forth in claim 10 wherein a bottom member is provided having an upstanding flange, said flange engaging the base of said slots in the lower ends of said tubular members.

12. The prefabricated panel set forth in claim 11 including a top member having a downwardly extending flange engaging the base of said slots in the upper ends of the hollow tubular members.

13. The prefabricated panel set forth in claim 12 wherein said hollow members are welded to said top and bottom members.

14. The prefabricated panel set forth in claim 13 wherein the sides of said panel are each provided with spaced vertically extending slots adapted to receive interconnecting strips when adjacent panels are brought into side-by-side relationship.

15. The prefabricated panel set forth in claim 14 wherein said body is formed with first and second portions defining a corner, a hollow tubular member having slots therein in each portion and an additional hollow member at the intersection of the two portions at the corner.

16. The prefabricated panel set forth in claim 14 including a groove at the lower edge of one face of said panels adapted to receive utilities.

17. The prefabricated panel set forth in claim 14 wherein said panel has portions of the body thereof adjacent the upper and lower ends of said hollow tubular members cut away providing access to the hollow members and respective top or bottom member for welding thereto.

* * * * *